US006931993B1

(12) United States Patent
Manole et al.

(10) Patent No.: US 6,931,993 B1
(45) Date of Patent: Aug. 23, 2005

(54) SYSTEM AND METHOD FOR A FLAMELESS TRACER / MARKER FOR AMMUNITION HOUSING MULTIPLE PROJECTILES UTILIZING CHEMLUCENT CHEMICALS

(75) Inventors: Leon R. Manole, Great Meadows, NJ (US); Stewart Gilman, Budd Lake, NJ (US); Kevin Stoddard, Hackettstown, NJ (US); Ernest L. Logsdon, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 10 days.

(21) Appl. No.: 10/708,162

(22) Filed: Feb. 12, 2004

Related U.S. Application Data

(60) Provisional application No. 60/481,765, filed on Dec. 10, 2003.

(51) Int. Cl.[7] ..... F42B 7/02
(52) U.S. Cl. ..... 102/458; 102/513; 362/34
(58) Field of Search ..... 102/395, 458, 102/502, 503, 529, 498, 513; 362/24, 34

(56) References Cited

U.S. PATENT DOCUMENTS

| | | | | | |
|---|---|---|---|---|---|
| 3,515,070 | A * | 6/1970 | Cutler et al. | ..... | 102/513 |
| 3,774,022 | A * | 11/1973 | Dubrow et al. | ..... | 362/34 |
| 4,553,481 | A * | 11/1985 | Ricci | ..... | 102/458 |
| 4,706,568 | A * | 11/1987 | Lundwall et al. | ..... | 102/513 |
| H770 | H * | 4/1990 | Kline et al. | ..... | 102/513 |
| 5,001,880 | A * | 3/1991 | Smith | ..... | 53/453 |
| 5,018,450 | A * | 5/1991 | Smith | ..... | 102/513 |
| 6,145,441 | A * | 11/2000 | Woodall et al. | ..... | 102/502 |
| 6,497,181 | B1 * | 12/2002 | Manole et al. | ..... | 102/513 |
| 6,543,365 | B1 * | 4/2003 | Vasel et al. | ..... | 102/502 |
| 6,615,739 | B2 * | 9/2003 | Gibson et al. | ..... | 102/513 |
| 2002/0134274 | A1 * | 9/2002 | Martinez et al. | ..... | 102/513 |
| 2003/0047105 | A1 * | 3/2003 | Vasel et al. | ..... | 102/502 |
| 2005/0016412 | A1 * | 1/2005 | Vasel et al. | ..... | 102/502 |

* cited by examiner

*Primary Examiner*—Michael Carone
*Assistant Examiner*—Troy Chambers
(74) *Attorney, Agent, or Firm*—Michael C. Sachs; John F. Moran

(57) ABSTRACT

Small, medium and large caliber ammunition housing multiple projectiles are traced by means of a tracing/marking system utilizing chemlucent chemicals. The tracing/marking system also provides target marking when using small, medium and large caliber ammunition. Multiple projectiles are coated in a chemlucent chemical (referenced as the coating) and placed in the ammunition. Additionally, a liquid chemlucent chemical in a separate container is placed in the ammunition. When launched or fired from a gun or munition, the separate container breaks and the coating and the chemlucent chemicals combine, emitting light. The present system applies to multiple projectiles that are either launched in a scatter pattern from a gun or dispersed in a scatter pattern after the housing of the ammunition opens up outside the gun after firing. For military ammunition, the tracing/marking system may use buckshot, steel balls, or tungsten balls. The tracing/marking system may also use various shaped projectiles such as stars, cubes, balls or flechettes. The chemlucent chemicals used by the tracing/marking system are non-flammable, biodegradable, and non-toxic.

7 Claims, 12 Drawing Sheets

SYSTEM AND METHOD FOR A FLAMELESS TRACER / MARKER FOR AMMUNITION HOUSING MULTIPLE PROJECTILES UTILIZING CHEMLUCENT CHEMICALS

CROSS REFERENCE TO RELATED APPLICATIONS

This application claims benefit under 35 USC 119(e) of provisional application 60/481,765, filed Dec. 10, 2003, the entire file wrapper contents of which provisional application are herein incorporated by reference as though fully set forth at length.

FEDERAL RESEARCH STATEMENT

The invention described herein may be manufactured, used and licensed by or for the U.S. Government for U.S. Government purposes.

BACKGROUND OF INVENTION

1. Field of the Invention

The present invention generally relates to munitions and cartridges employing a main projectile which contains multiple projectiles; these munitions and cartridges are used for training and tactical purposes in military applications and used for hunting in commercial applications. In particular, this invention relates to small, medium and large caliber ammunition including shot gun, mortar, canister, tank, artillery and canon caliber munitions comprising chemlucent chemicals capable of providing tracers to detail the trajectory of the multiple projectiles and mark target impact locations. More specifically, the main projectile and the multiple projectiles launched from the main projectile provides a trace/mark of its flight and impact area on the target. This is accomplished by chemlucent chemicals coated on the multiple projectiles emit light in visible light or IR spectrum. The chemlucents used are biodegradable, non-toxic and non-flammable.

2. Background of the Invention

In both military and non-military organizations, training and tactical exercises commonly employ materials capable of providing a visible trace of a projectile's trajectory after firing from a weapon. This visible trace, or tracer, assures that the projectile has been delivered to its desired target site and that its flight path has been traced from gun tube to target.

A requirement for the tracer is that an observer should be able to see the tracer in the applications it is intended for. The present invention can be used for observation of multiple projectiles in low light conditions.

Current tracer technology employs pyrotechnic compositions comprised of pyrotechnic materials that burn and create light. These pyrotechnic compositions are typically loaded into the back end of the projectile, or round. Common to the industry, when a projectile is loaded into a cartridge case containing a primer and propellant, the entire round is called a cartridge. After the projectile is fired from the weapon, the tracer ignites and burns, creating a visible light that can be observed as the projectile travels to its target. The observer or gunner can consequently see the trace of the projectile flight. If necessary, the observer can then adjust the weapon so that the next round fired can impact the desired target location. Exemplary pyrotechnic compositions suitable for such purpose may contain such chemicals as strontium nitrate, magnesium powder, potassium nitrate, barium nitrate, chlorinated rubber and the like.

Although such conventional methods have met with some degree of success, workers in the art have encountered certain difficulties. For example, tracer ammunition has frequently resulted in fires on training ranges that have been attributed to energetic material tracers contacting and burning surrounding brush and other ground material. These fires incur additional costs in extinguishing the fires and also interrupt training exercise. Consequently, training exercises may be extended to replace time lost, thereby incurring additional expense. Furthermore, materials used in pyrotechnic tracers are environmentally unfriendly. These materials often pose environmental hazards to training areas as a result of toxic emissions into the atmosphere and such materials leaching into ground water. Still further, tracer materials commonly in use are impact and pressure sensitive. Since projectiles housing the pyrotechnic materials may be transported, the nature and explosive properties of these pyrotechnic materials add significant costs and danger to personnel.

Tracers have also utilized chemlucent or chemiluminescent materials. The chemlucent or chemiluminescent materials are similar to conventional chemiluminescents, however, certain ingredients and manufacturing techniques were developed to obtain the capability of long duration (up to several hours for marker application) and high light intensity tracing and marking capability. The oxalate component employed is in a liquid (contained in glass vials) and may also be made into a powdered form. When the oxalate is mixed with liquid peroxide, a non-toxic slurry is formed that is non-flammable and biodegradable and gives off light. In addition, the chemiluminescent can provide a visible or infrared (IR) light source. The infrared (IR) light source provides a stealth capability such that only soldiers with infrared (IR) vision equipment can observe the trace or mark. As taught in U.S. Pat. No. 6,497,181, granted on Dec. 24, 2002, which is incorporated herein by reference, the chemlucent can be used to provide a trace for a projectile. This projectile, carried the chemlucent as a cargo, to be dispersed by the projectile after impact onto a target and therefore mark the target with the chemlucent material.

For purposes of explanation it should be noted that the following is commonly known to the industry. Ammunition that contains a main projectile, which houses multiple projectiles, and the main projectiles breaks up in the gun or at the gun muzzle exit, releasing the multiple projectiles to continue on to engage the target, is known as or referred to as a muzzle action cartridge, muzzle action round or muzzle action projectile. Ammunition that contains a main projectile, which houses multiple projectiles, and the main projectiles continues on to target a distance until a fuze is activated and expels the multiple projectile payload to continue on and engage the target, is known as or referred to as a cargo cartridge or cargo round or cargo projectile.

Although this technology has proven to be useful, it would be desirable to present additional improvements. What is needed is a way to provide trace and mark to multiple projectiles housed in a single main projectile, which is part of a ammunition cartridge for muzzle action projectiles. It is also desirable to provide trace and mark for a main cargo projectile that carries multiple projectiles a distance and then with fuze action expel the multiple projectiles (the main projectile falls to the ground) to continue and engage the target. Therefore, trace is needed for the main projectile and then trace and mark is needed for the multiple projectiles after they leave the main projectile. The method of providing the trajectory trace and target impact mark should be non-flammable, biodegradable, and non-toxic. Another need is to have a chemlucent chemical, in a powdered or slurry form, that emits light (visible or IR) and can be fired along with the multiple projectiles and travel in the same vicinity of the projectiles and mark the target impact area. The need is for small, medium and large caliber ammunition including shotgun, canister, cargo, mortar, artillery and tank ammunition projectiles that are part of a cartridge. The need for such a system has heretofore remained unsatisfied.

SUMMARY OF INVENTION

OTe present invention satisfies this need, and presents a system and an associated method (collectively referred to herein as "the system"or "the present system") for providing trajectory traces and target impact marks using small, medium and large caliber ammunition which contains a main projectile housing multiple projectiles known as a payload. These main projectiles are part of a cartridge or ammunition round or item.

It should be noted that the shotgun cartridge contains multiple shot known as buckshot that are launched directly from the gun tube (muzzle action cartridge).

The small, medium and large caliber canister cartridge can be similar to a shotgun cartridge and may launch the multiple projectiles directly from the gun (muzzle action). These multiple projectiles are usually steel or tungsten balls, cubes, or flechettes (other projectiles may also be used in the industry and are applicable for the technology of this patent). There are also small, medium and large caliber canister cargo projectiles that are launched from the gun tube as a single main cargo projectile containing the multiple projectiles inside. When the main cargo projectile goes a predetermined distance a fuze is activated that pushes or expels the multiple projectiles (payload) out of the main cargo projectile.

Following the release of the payload, the main cargo projectile goes to the ground. The payload or multiple projectiles travel on to and engage (impact) the target. Similarly, mortar, tank and artillery main projectiles are intact as they exit the gun. They are mostly cargo projectiles and only occasionally muzzle action projectiles. As the main mortar, tank and artillery cargo projectile goes a predetermined distance or approaches its target, a fuze is activated that pushes or expels the multiple projectiles (payload) out of the main cargo projectile. The multiple projectiles continue on to their target while the main cargo projectile goes to the ground.

In order to provide trace and mark to the multiple projectiles or payload, a coating of a chemlucent chemical (referenced as the coating) is applied to the multiple projectiles. The projectiles are then placed or loaded into the ammunition item in the same manner as commonly loaded in the industry. Optionally, this chemlucent coating may contain waxes, silicone or liquid/slurry plastics to aid in adherence of the chemlucents to the multiple projectiles. Additionally, a liquid chemlucent chemical in a separate bag container and an optional chemlucent powder surrounding the multiple projectiles is placed in the ammunition.

When launched or fired from a gun or munition, the separate container breaks and the coating and the chemlucent chemicals combine, emitting light from the surface of the multiple projectiles and the chemlucent chemicals surrounding the multiple projectiles. The present system applies to multiple projectiles that are either launched in a scatter pattern from a gun (muzzle action) or dispersed in a scatter pattern after the housing of the cargo projectile opens up outside the gun after firing.

Another embodiment is to place chemlucent liquid in glass, plastic or composite vials or inside a bag along with the multiple projectiles. As the projectiles are fired from the gun, the two chemicals mix, emit light from the surface of the multiple projectiles and the chemlucent chemicals that travel with the multiple projectiles. Upon impact with the target the chemicals are deposited onto the target, from the surface of the projectiles and the chemlucent powder following the projectiles, therefore marking it. It should be noted that the chemlucent powder that is not coated to the multiple projectiles will only travel approximately up to 50 meters. The chemlucent coated multiple projectiles will provide trace and mark to the intended target.

For military ammunition, the present system may use buckshot, steel balls, or tungsten balls. The system may also use various shaped projectiles such as stars, cubes, balls, or flechettes (other multiple projectiles are applicable for this technology). The present system utilizes chemlucent chemicals to trace the trajectory of the multiple projectiles and show the range and scope of projectile distribution. These chemlucent chemicals are nonflammable, biodegradable, and non-toxic. The present system enables the user to determine the effectiveness against single or multiple targets and adjust the firing of the next round. In addition, the present system allows the user to judge the effectiveness of the distribution of a particular projectile type and its effectiveness in engaging multiple targets at different ranges. Further ore, the present system allows for marking target impact locations, indicating the effectiveness of each round fired and enhancing training of military personnel.

The present system can provide a trace only, of the main cargo projectile, if the main cargo projectile is transparent or translucent (made of plastics or composites). This is accomplished by the light emitted from the coated multiple projectiles, passing through the transparent or translucent main cargo projectile. Once the main cargo projectile expels its payload, the main cargo projectile falls to the ground and only the trace and mark of the multiple projectiles is seen. If the main projectile is opaque, made of steel or aluminum, then the flight of the main cargo projectile will not have a trace.

For commercial use, the present system utilizes bchemlucent coated uckshot loaded in a shotgun. cartridge A trace of the trajectory of the buckshot enables a user to evaluate the effectiveness of each shot and adjust the trajectory of future shots. As an advantage, the present system is nonflammable, biodegradable, and non-toxic and can be used on all training ranges and hunting locations.

The light emitted by the present system that provides tracing capability is created by combining a first chemlucent chemical (chemlucent chemical 1) with a second chemlucent chemical (chemlucent chemical 2). The chemlucent chemical 1 comprises, for example, a peroxide and alcohol mix; the chemlucent chemical 2 comprises, for example, an oxalate liquid or powder. The multiple projectiles are coated with chemlucent chemical 2 in liquid form and allowed to dry, forming coated projectiles. Optionally, chemlucent chemical 2 coating may contain waxes, silicone or liquid/slurry plastics to aid in adherence of the chemlucents to the multiple projectiles. The coated multiple projectiles are then loaded in a single main projectile and made into a cartridge in the same manner as presently done in the industry. Optionally, chemlucent chemical 2 in powder form may be placed among the coated multiple projectiles inside the main projectile or cartridge (as in the case of a shotgun cartridge).

A bag containing chemlucent chemical 1 is loaded in the main projectile or shotgun cartridge among the coated multiple projectiles. In an alternate embodiment chemlucent chemical 1 is loaded in a glass or plastic or composite vial and placed in a bag with optional chemlucent 2 powder. When the coated projectiles are launched from the gun tube or munition, the coated projectiles puncture a bag containing the chemlucent chemical 1, breaking the bag. Alternatively, the bag breaks under the setback forces induced by gun launch. The bag could be made of any plastic or composite material that is compatible with the chemlucent chemicals. Such compatible plastics are polyethylene or polypropylene. If vials are used to contain ,e chemlucent chemical 1, it breaks under the setback forces induced by gun launch or by the projectiles that impact the vials during gun launch. Chemlucent chemical 1 and chemlucent chemical 2 mix, creating a chemlucent chemical mixture. The chemlucent chemical mixture emits light, providing a trajectory trace to the target.

In one embodiment, additional chemlucent chemical 2 in powder form is loaded with the coated projectiles. The additional chemlucent chemical 2 combines with chemlucent chemical 1 after the bag is broken or ruptured by the coated projectiles, forming additional chemlucent chemical mixture. When the coated projectiles strike a hard object, a portion of the chemlucent chemical mixture transfers from the projectile to the object, marking the target impact location on the object.

In another embodiment, the chemlucent chemical mixture is a visible formulation, emitting visible light. In another embodiment, the chemlucent chemical mixture is an infrared (IR) formulation requiring night vision devices to observe the trajectory trace target mark.

The assembly for all the aforementioned projectiles and cartridges are done in the standard way performed in the industry, except for the addition of the chemlucent chemicals, bags and/or vials which are included with the loading of the multiple projectiles.

BRIEF DESCRIPTION OF DRAWINGS

The various features of the present invention and the manner of attaining them are described in greater detail with reference to the following description, claims, and drawings, wherein reference numerals are reused, where appropriate, to indicate a correspondence between the referenced items, and wherein:

DETAILED DESCRIPTION

Figure 1:
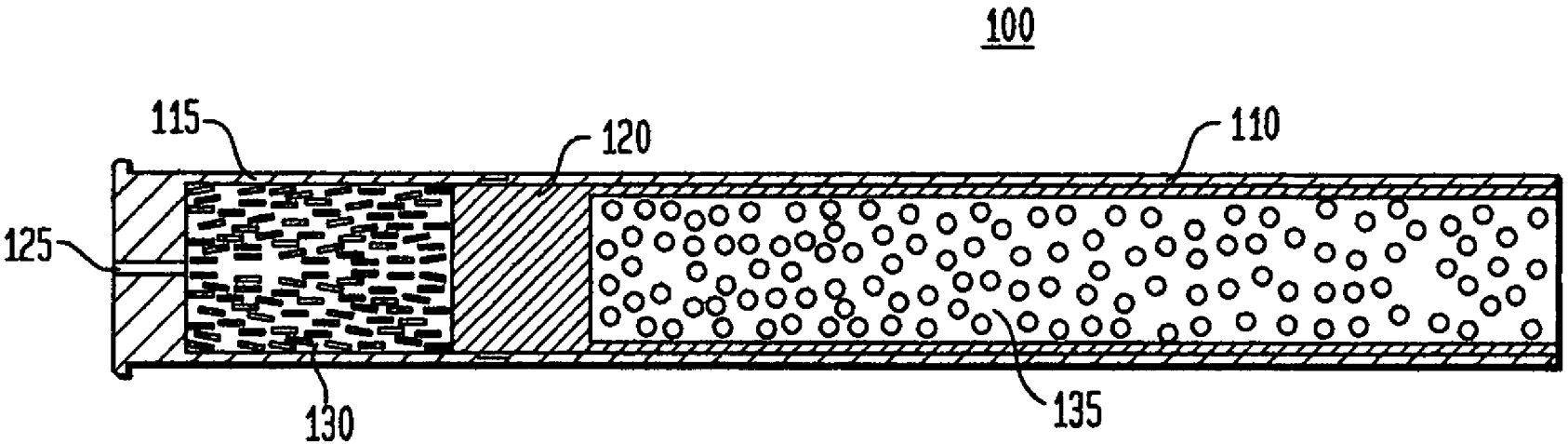
FIG. 1 (PRIOR ART)
FIG. 1 is a cross-sectional view of a conventional shotgun cartridge.

FIG. 1 is a cross-sectional view of a conventional shotgun cartridge 100. The shotgun cartridge 100 comprises a case 110, a head 115, a wad 120, a primer 125, a propellant 130, and shot 135. Head 120 comprises, for example, brass.

Figure 2:
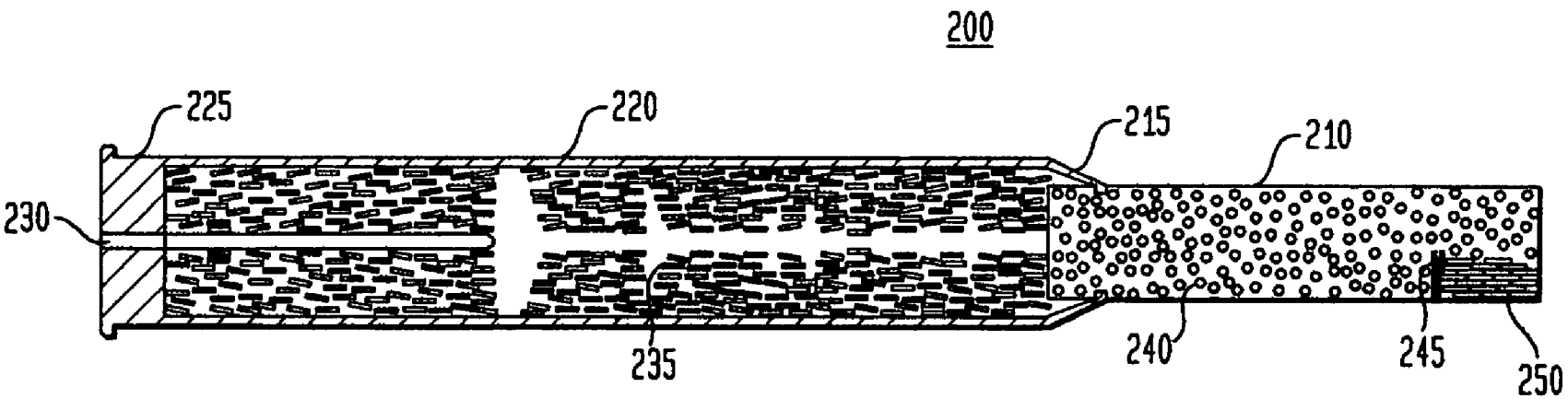
FIG. 2 (PRIOR ART)
FIG. 2 is a cross-sectional view of a conventional 105 or 120 mm canister cartridge.

FIG. 2 is a cross-sectional view of a conventional 105 or 120 mm canister cartridge 200 (also referenced as canister cartridge 200). Canister cartridge 200 comprises a main canister projectile 210, a case cap (adaptor) 215, a cartridge case 220, a case base 225, a primer 230, a propellant 235, balls 240, cubes 245, and flechettes 250. Balls 240, cubes 245 and flechettes typically comprise steel or tungsten.

Figure 3:
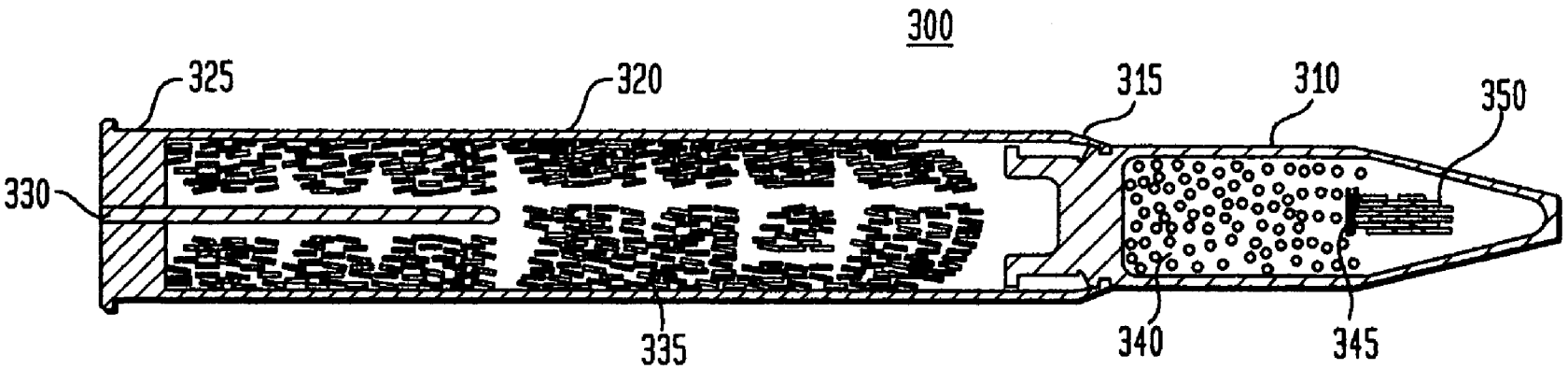
FIG. 3 (PRIOR ART)
FIG. 3 is a cross-sectional view of a conventional 105 or 120 mm artillery or tank cartridge carrying various projectiles.

FIG. 3 is a cross-sectional view of a conventional 105 or 120 mm artillery or tank cartridge 300 (also referenced as tank cartridge 300). Tank cartridge 300 comprises a tank or artillery main cargo projectile 310, a case adapter 315, a cartridge case 320, a case base 325, a primer 330, a propellant 335, balls 340, cubes 345, and flechettes 350. Case base 325 comprises a seal, not shown. Balls 340, cubes 345 and flechettes typically comprise steel or tungsten.

Figure 4:
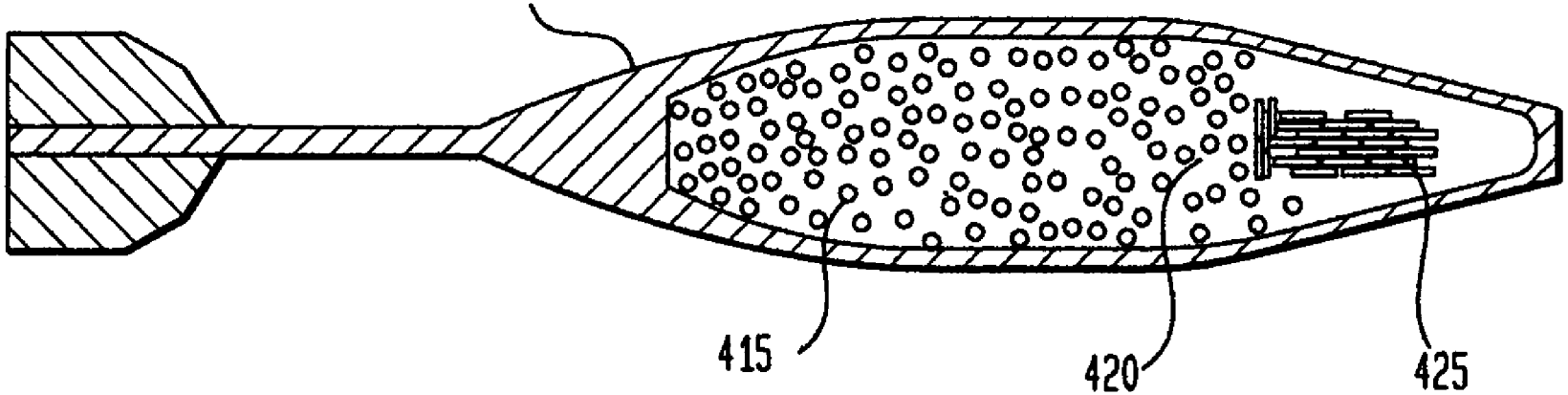
FIG. 4 (PRIOR ART)
FIG. 4 is a cross-sectional view of a conventional 60, 81, or 120 mm mortar main cargo projectile carrying various projectiles.

FIG. 4 is a cross-sectional view of a conventional 60, 81 or 120 mm mortar main cargo projectile 400 (also referenced as mortar projectile 400). Mortar projectile 400 comprises a mortar projectile main body 410, balls 415, cubes 420, and flechettes 425. Balls 415, cubes 420 and flechettes 425 typically comprise steel or tungsten.

Figure 5:
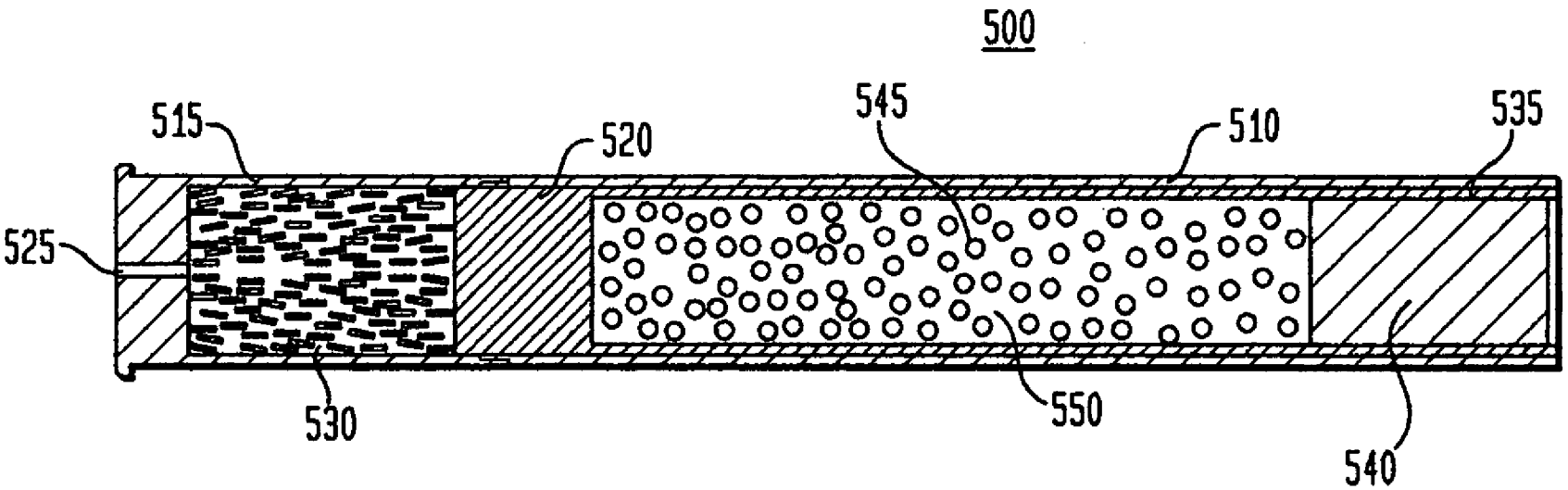
FIG. 5 is a cross-sectional view of a shotgun cartridge showing coated multiple projectiles and a chemlucent chemical in a bag, each surrounded by optional chemlucent chemical powder.

FIG. 5 portrays an exemplary overall environment in which a system and associated method for a flameless tracer/marker for multiple projectiles utilizing chemlucent chemicals according to the present invention may be used.

The present invention is illustrated by exemplary shotgun cartridge 500. Shotgun cartridge 500 comprises a case 510, a head 515, a wad 520, a primer 525, a propellant 530, a bag 535, chemlucent chemical 1, 540, shot 545, and chemlucent chemical 2, 550. Bag 535 is comprised of polyethylene or polypropylene plastic or a composite material that is compatible with chemical 1, 540 and chemlucent chemical 2, 550.

Chemlucent chemical 1, 540, is contained in bag 535 and comprises, for example, peroxide and alcohol. Shot 545 is optionally coated with chemlucent chemical 2, 550, in liquid form and allowed to dry. Optionally, chemlucent chemical 2, 550 coating may contain waxes, silicone or liquid/slurry plastics to aid in adherence of the chemlucent chemical 2, 550 to shot 545. Shot 545 is loaded into the shotgun cartridge 500. Optionally, chemlucent chemical 2, 550, in powdered form is a loaded into the shotgun cartridge 500 with shot 545. Chemlucent chemical 2, 550, may comprise, for example, oxalate powder. Bag 535 is placed in the shotgun cartridge 500 with shot 545.

When shotgun cartridge 500 is fired in a gun, chemlucent chemical 2 coated shot 545 punctures bag 535 and passes through the chemlucent chemical 1, 540, contained in bag 535. Chemlucent chemical 1, 540, combines with chemlucent chemical 2, 550, on the coated shot 545. The mixture of chemlucent chemical 1, 540, and chemlucent chemical 2, 550, emits visible light from the coating on each of the shot, providing a trajectory trace and target mark from each of the shot that travels to the target. In additional, the optional chemlucent powder chemical 2 travels through chemlucent chemical 1 and emits visible light and travels with the shot 545 providing a trace of its flight and a mark on the target. The chemlucent powder can travel up to 50 meters with the shot 545. In an embodiment, chemlucent chemical 1, 540, and chemlucent chemical 2, 550, comprise an infrared (IR) formulation requiring night vision devices (NVD) to observe the trace and mark.

Figure 6:
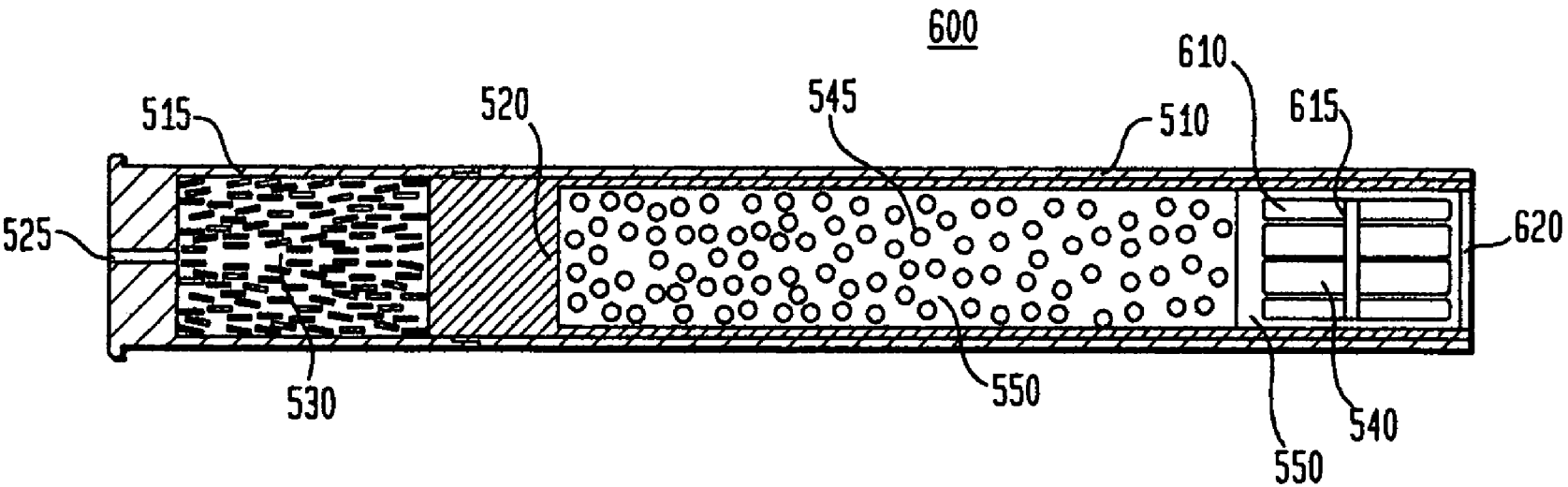
FIG. 6 is a cross-sectional view of a shotgun cartridge showing the coated multiple projectiles surrounded by an optional chemlucent chemical powder and the chemlucent chemicals in glass, plastic or composite vials suspended in a plastic spider and surrounded by an optional chemlucent chemical powder.

FIG. 6 is a cross-sectional view of a shotgun cartridge 600 with chemlucent chemical 1, 540, placed in glass or plastic or composite vials 610 held apart by a plastic spider 615. Shotgun cartridge 600 comprises case 510, head 515, wad 520, primer 525, propellant 530, shot 545, and chemlucent chemical 2, 550. The plastic spider 615 is placed in bag 620. and surrounded by chemlucent chemical 2, 550. Bag 620 is comprised of polyethylene or polypropylene plastic or a composite material that is compatible with chemical 1, 540 and chemlucent chemical 2, 550. Shot 545 is coated with chemlucent chemical 2, 550, in liquid form and allowed to dry before being loaded into the cartridge. Optionally, chemlucent chemical 2, 550 coating may contain waxes, silicone or liquid/slurry plastics to aid in adherence of the chemlucent chemical 2, 550 to shot 545. In addition, shot 545 may optionally be surrounded by chemlucent chemical 2, 550, in powder form.

In an embodiment, bag 535 (FIG. 5) and bag 620 (FIG. 6) may be placed in other locations among the shot 545. Optionally, shot 545 may be coated with chemlucent chemical 2, 550, in liquid form and allowed to dry. In addition, shot 545 may optionally be surrounded by chemlucent chemical 2, 550, in powder form.

In a further embodiment, chemlucent chemical 1, 540, and chemlucent chemical 2, 550, may be placed in separate bags and positioned in shotgun cartridge 600 to allow shot 545 to puncture both bags, allowing chemlucent chemical 1, 540, and chemlucent chemical 2, 550, to combine and emit light. Chemlucent chemical 1, 540, and chemlucent chemical 2, 550, combine, adhere to shot 545, and emit light. Optionally, shot 545 are coated with chemlucent chemical 2, 550, in liquid form and allowed to dry. In addition, shot 545 may optionally be surrounded by chemlucent chemical 2, 550, in powder form.

The embodiments illustrated in FIGS. 5 and 6 may use either visible or IR light chemlucent formulations.

Figure 7:
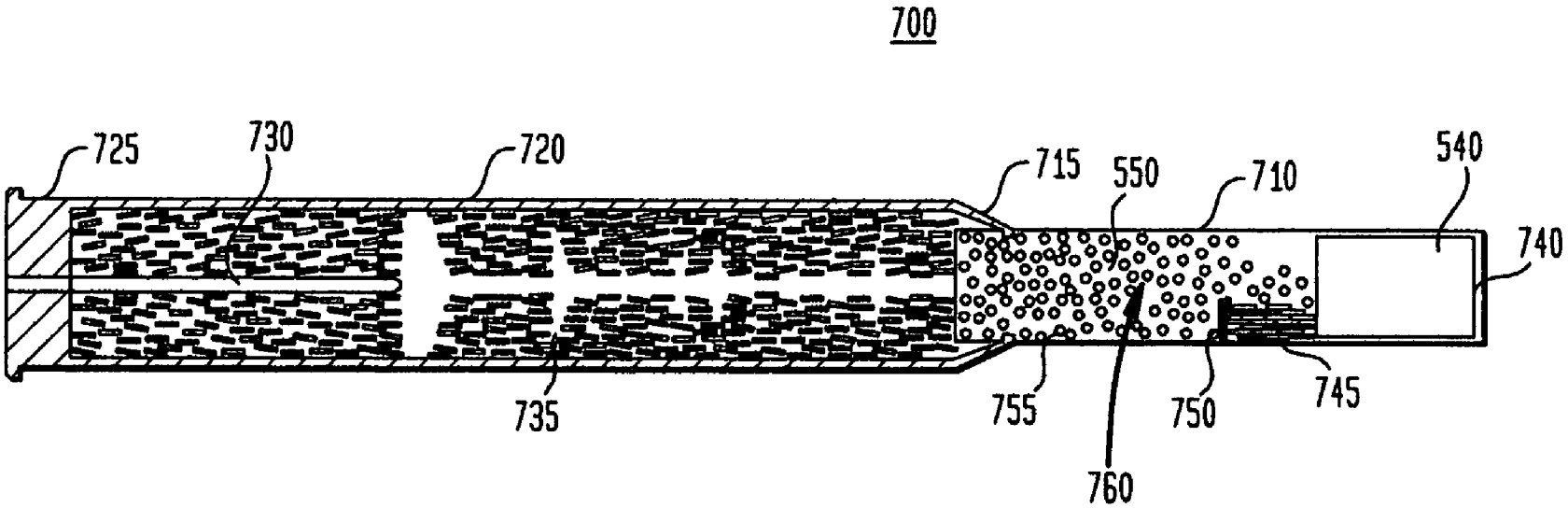
FIG. 7 is a cross-sectional view of a 105 or 120 mm canister cartridge showing the location of a chemlucent chemical in a plastic or composite bag and the location of the coated multiple projectiles.

FIG. 7 is a cross-sectional view of a 105 or 120 mm canister cartridge 700 (also referenced as canister cartridge 700). Canister cartridge 700 comprises a main canister projectile 710, a case cap (adapter) 715, a cartridge case 720, a case base 725, a primer 730, a propellant 735, a bag 740, flechettes 745, cubes 750, balls 755, chemlucent chemical 1, 540, and chemlucent chemical 2, 550. Case base 725 comprises a seal, not shown. The flechettes 745, cubes 750, and balls 755, collectively referenced as multiple projectiles 760, are coated with chemlucent chemical 2 and allowed to dry before being loaded into the cartridge.

Optionally, chemlucent chemical 2, 550 coating may contain waxes, silicone or liquid/slurry plastics to aid in adherence of the chemlucent chemical 2, 550 to multiple projectiles 760. In an embodiment, the multiple projectiles 760 comprise steel. In a further embodiment, the multiple projectiles 760 comprise tungsten. Other projectiles may also be used in the industry and are applicable for the technology of this patent. The main canister projectile 710 is comprised of steel, aluminum, plastic or composite which is standard in the industry.

The projectiles 760 are placed in the main canister projectile 710 with bag 740 containing chemlucent chemical 1, 540. It is noted that loading of this projectile 760 is done exactly the same as in the industry except the bag and chemlucent chemicals are added when the multiple projectiles 760 are added to the main canister projectile 710. Similarly cartridges and projectiles for FIGS. 5 to 12 will be built in same manner as industry standard except the chemlucent chemicals and their containers will be added along with the multiple projectiles 760. When the main canister projectile 710 is fired or launched from a gun, the multiple projectiles 760 puncture bag 740 and pass through the chemlucent chemical 1, 540, contained in bag 740. Alternatively, bag 740 breaks under the setback forces induced by gun launch of main canister projectile 710. Chemlucent chemical 1, 540, combines with chemlucent chemical 2, 550, on the multiple projectiles 760 to emit light, providing a trajectory trace and target mark.

In an embodiment, optional chemlucent chemical 2, 550, in powder form is placed in the main canister projectile 710 with the multiple projectiles 760. When the chemlucent chemical 2, 550, in powdered form combines with chemlucent chemical 1, 540, the resulting chemlucent chemical mixture emits light. In yet another embodiment, chemlucent chemical 1, 540, and chemlucent chemical 2, 550, comprise an infrared (IR) formulation requiring night vision devices (NVD) to observe the trace and mark.

As previously stated some main canister projectiles 710 are muzzle action and some are main canister cargo projectiles 710. If the main canister projectile 710 is designed to be muzzle action and release the multiple projectiles 760 inside the gun tube or at the muzzle, then the main canister projectile 710 is consumed or breaks up inside the gun tube. The coated multiple projectiles 760 leave the gun tube, emitting light, therefore providing trace or their flight from the gun muzzle to the target and mark the target as aforementioned. The optional powdered chemlucents will also travel with the multiple projectile 760 and provide trace and mark up to 50 meters.

If the main canister projectile 710 has a fuze, it is known as a main canister cargo projectile 710. After gun launch, the main canister cargo projectile 710 will travel down range intact, with the multiple projectiles 760 inside. Upon activation of the fuze, the multiple projectiles 760 are expelled from cargo projectile 710. Main canister cargo projectile 710 falls to the ground and multiple projectiles 760 travel on the target. The multiple projectiles emit light from the chemlucent coating and provide a trace to the target. Upon hitting the target the multiple projectiles 760 mark the target by depositing some of the coated chemlucent on the multiple projectile 760 surface onto the target. If the main canister cargo projectile 710 is made of a transparent material (plastic or composite), then the main canister cargo projectile will provide a trace of its flight due to the chemlucents inside (coated on and between the multiple projectiles 760). If the main canister cargo projectile 710 is made of opaque material then its flight will not be traced. In this case only the multiple projectiles 760 will provide trace and mark. In addition, if optional chemlucent powder chemical 2550 was among the multiple projectiles 760 these chemlucent chemicals will follow the flight of the projectiles 760 for a limited distance, up to 50 meters to provide a trace and mark.

Figure 8:
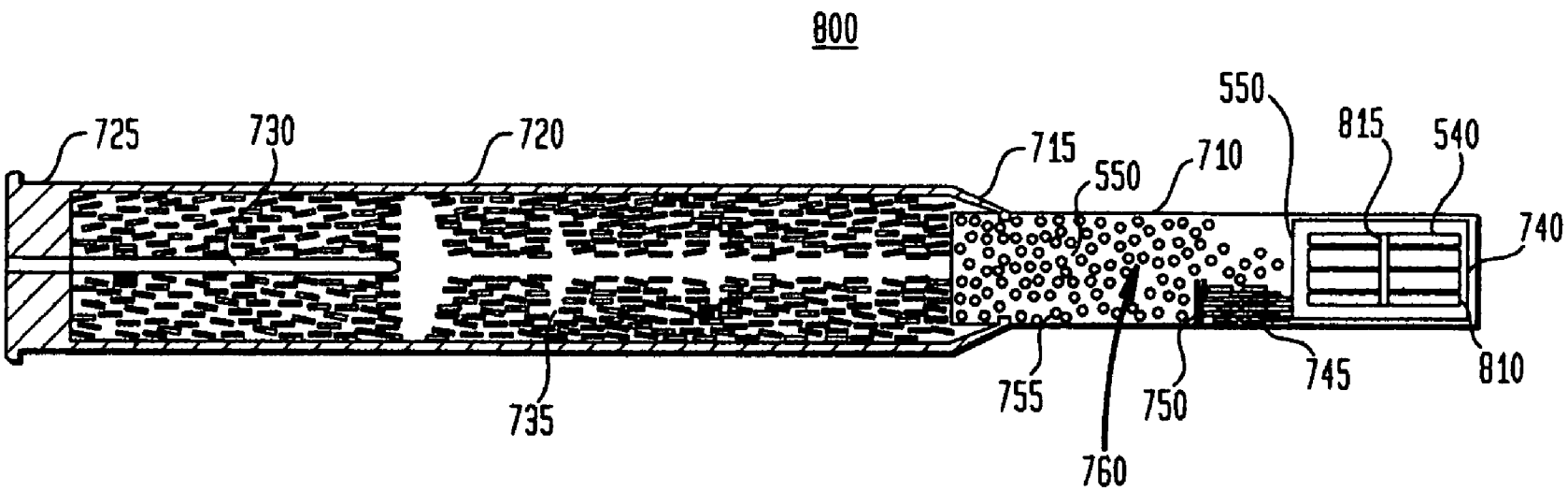
FIG. 8 is a cross-sectional view of a 105 or 120 mm canister cartridge showing the coated multiple projectiles surrounded by an optional chemlucent chemical powder and the chemlucent chemicals in glass or plastic or composite vials suspended in a plastic spider and surrounded by an optional chemlucent chemical powder all in a plastic or composite bag.

FIG. 8 is a cross-sectional view of a 105 or 120 mm canister cartridge 800 (also referenced as canister cartridge 800) with chemlucent chemical 1, 540, placed in glass vials 810 held apart by a plastic spider 815. Canister cartridge 800 comprises a main canister projectile 710, a case cap (adapter) 715, a cartridge case 720, a case base 725, a primer 730, a propellant 735, a bag 740, flechettes 745, cubes 750, balls 755, chemlucent chemical 1, 540, and chemlucent chemical 2, 550. Case base 725 comprises a seal, not shown. The flechettes 745, cubes 750, and balls 755 are also referenced as multiple projectiles 760. In an embodiment, the multiple projectiles 760 comprise steel. In a further embodiment, the multiple projectiles 760 comprise tungsten.

The plastic spider 815 with glass vials 810 is placed in bag 740 and surrounded by chemlucent chemical 2, 550 in either liquid or powder form. Multiple projectiles 760 are coated with chemlucent chemical 2, 550, in liquid form and allowed to dry. Optionally, chemlucent chemical 2, 550 coating may contain waxes, silicone or liquid/slurry plastics to aid in adherence of the chemlucent chemical 2, 550 to multiple projectiles 760. The coated multiple projectiles 760 are then loaded into main canister projectile 710 in the same manner as commonly done in the industry along with the bag 740. In addition, multiple projectiles 760 may optionally be surrounded by chemlucent chemical 2, 550, in powder form.

In an embodiment, bag 740 may be placed in other locations among the multiple projectiles 760.

In a further embodiment, chemlucent chemical 1, 540, and chemlucent chemical 2, 550, may be placed in separate bags and positioned within main canister projectile 710 to allow multiple projectiles 760 to puncture both bags, mixing the chemlucent chemical 1, 540, and chemlucent chemical 2, 550. Alternatively, the separate bags break under the forces induced by gun launch of main canister projectile 710. Chemlucent chemical 1, 540, and chemlucent chemical 2, 550, combine and adhere to multiple projectiles 760 and emit light. When chemlucent chemical 1 and chemlucent chemical 2 are in bags in main canister projectile 710 then optionally, multiple projectiles 760 are coated with chemlucent chemical 2, 550, in liquid form and allowed to dry. In addition, projectiles 760 are optionally surrounded by chemlucent chemical 2, 550, in powder form.

All the aspects previously referenced from FIG. 7 canister cartridge 700 referring to muzzle action or cargo action are applicable to FIG. 8 canister cartridge 800.

Figure 9:
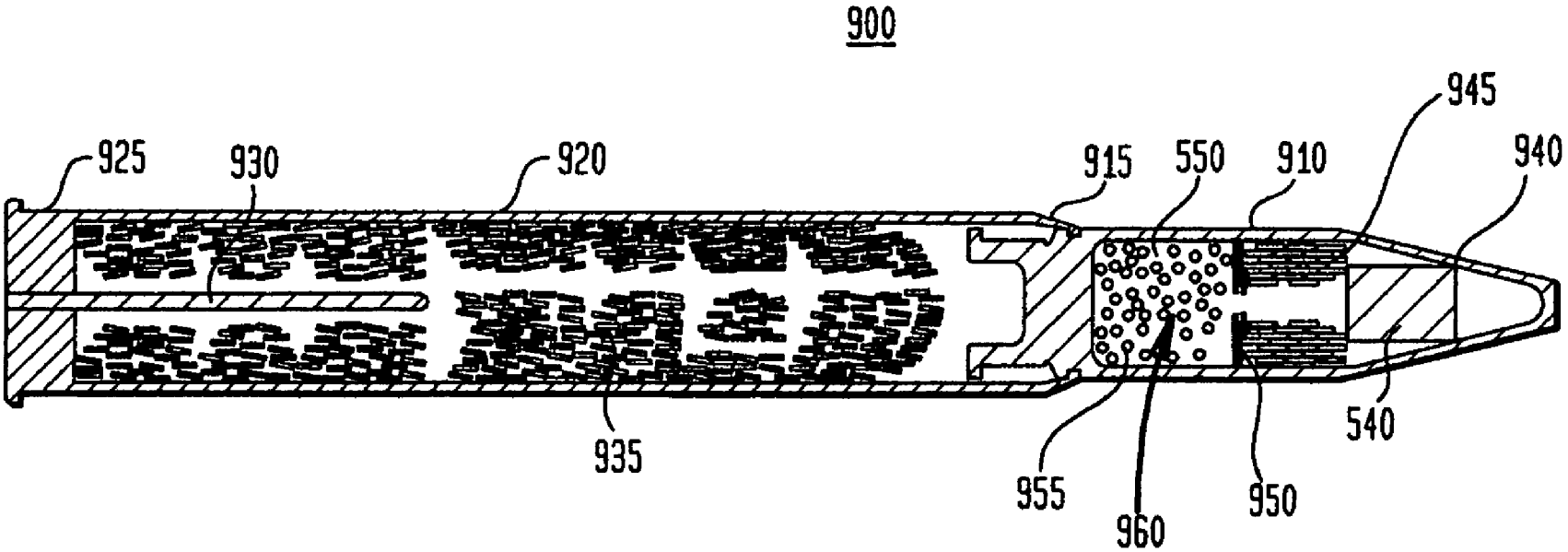
FIG. 9 is a cross-sectional view of a 105 or 120 mm artillery or tank cartridge showing the location of a chemlucent liquid in a plastic or composite bag and the location of the coated multiple projectiles surrounded by optional chemlucent chemical powder.

FIG. 9 is a cross-sectional view of a 105 or 120 mm artillery or tank cartridge 900 (also referenced as tank cartridge 900). Tank cartridge 900 comprises a tank or artillery main projectile 910, a case adapter 915, a cartridge case 920, a case base 925, a primer 930, propellant 935, a bag 940, flechettes 945, cubes 950, balls 955, chemlucent chemical 1, 540, and chemlucent chemical 2, 550. Case base 925 comprises a seal, not shown. The flechettes 945, cubes 950, and balls 955, collectively referenced as multiple projectiles 960, are coated with chemlucent chemical 2. Optionally, chemlucent chemical 2, 550 coating may contain waxes, silicone or liquid/slurry plastics to aid in adherence of the chemlucent chemical 2, 550 to multiple projectiles 960. [I an embodiment, the projectiles 960 comprise steel. In a further embodiment, the multiple projectiles 960 comprise tungsten.

The multiple projectiles 960 are placed in tank or artillery main projectile 910 with bag 940 containing chemlucent chemical 1, 540. When the tank cartridge 900 is fired, projectiles 760 puncture bag 940, and pass through the chemlucent chemical 1, 540, contained in bag 940. Alternately, bag 940 breaks under the setback forces induced by gun launch of tank or artillery projectile main projectile 910. Chemlucent chemical 1, 540, and combines with chemlucent chemical 2, 550, on the projectiles 960 to emit light, providing a trajectory trace and target mark. Most multiple tank and artillery projectiles 910 are designed with a fuze action and the main cargo projectile 910 goes a distance before the fuze is activated and expels the multiple projectiles 960. If the main cargo projectile 910 is fuze action, then there is a spin imparted to the main projectile 910 by the fin which further mixes the two chemlucent chemicals.

In one embodiment, optional chemlucent chemical 2, 550, in powder form is placed in the tank or artillery main projectile 910 with multiple projectiles 960. When the chemlucent chemical 2, 550, in powder form combines with chemlucent chemical 1, 540, the resulting chemlucent chemical mixture emits light. For short distances (approximately up to 50 yards) these chemicals that are not attached to the multiple projectiles 960 will travel with the multiple projectiles 960 providing for an enhanced trace and mark of the flight and impact on target of withhe multiple projectiles 960. In another embodiment, chemlucent chemical 1, 540, and chemlucent chemical 2, 550, comprise an infrared (IR) formulation requiring night vision devices (NVD) to observe the trace and mark.

If the main tank or artillery projectile 910 is designed to be muzzle action and release the multiple projectiles 960 inside the gun tube or at the muzzle, then the main tank or artillery projectile 910 is consumed or breaks up inside the gun tube or as it exits the gun tube. The coated multiple projectiles 960 leave the gun tube, emitting light, therefore providing trace or their flight from the gun muzzle to the target and mark the target as aforementioned. The optional powdered chemlucents will also travel with the multiple projectile 960 and provide trace and mark up to 50 meters.

If the main tank or artillery projectile 910 has a fuze (not shown), it is known as a main tank or artillery cargo projectile 910. After gun launch, the main tank or artillery cargo projectile 910 will travel down range intact, with the multiple projectiles 960 inside. Upon activation of the fuze, the multiple projectiles 960 are expelled from tank or artillery main cargo projectile 910. Tank or artillery main cargo projectile 910 falls to the ground and multiple projectiles 960 travel on the target. The multiple projectiles emit light from the chemlucent coating and provide a trace to the target. Upon hitting the target the multiple projectiles 960 mark the target by depositing some of the coated chemlucent from the multiple projectile 960 surface onto the target. If the tank or artillery main cargo projectile 910 is made of a transparent material (plastic or composite), then the tank or artillery main cargo projectile 910 will provide a trace of its flight due to the chemlucents inside (coated on and between the multiple projectiles 960). If the tank or artillery main cargo projectile 910 is made of opaque material then its flight will not be traced. In this case only the multiple projectiles 960 will provide trace and mark. In addition, if optional chemlucent powder chemical 2550 was among the multiple projectiles 960 these chemlucent chemicals will follow the flight of the projectiles 760 for a limited distance, up to 50 meters to provide a trace and mark.

Figure 10:
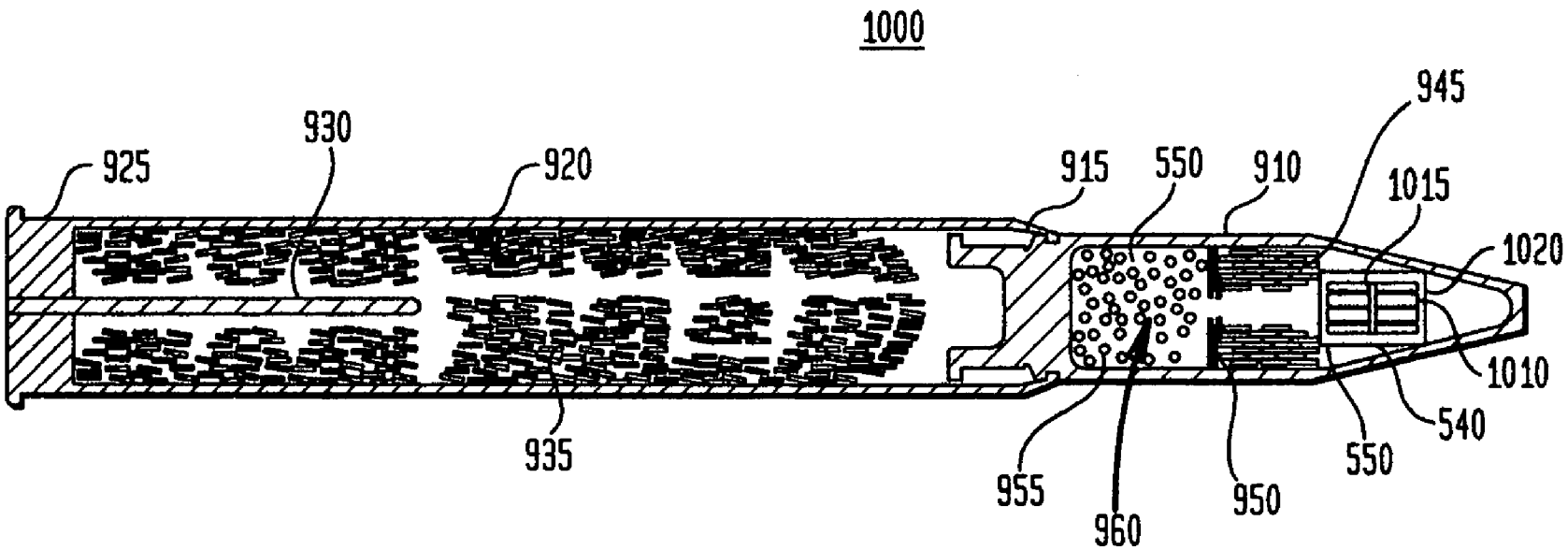
FIG. 10 is a cross-sectional view of a 105 or 120 mm artillery or tank cartridge showing the coated multiple projectiles surrounded by an optional chemlucent chemical powder and the chemlucent chemicals in glass or plastic or composite vials suspended in a plastic spider and surrounded by an optional chemlucent chemical powder.

FIG. 10 is a cross-sectional view of a 105 or 120 mm artillery or tank cartridge 1000 (also referenced as tank cartridge 1000) with chemlucent chemical 1, 540, placed in glass, plastic or composite vials 1010 held apart by a plastic spider 1015. Tank cartridge 1000 comprises a tank or artillery main projectile 910, a case adapter 915, a cartridge case 920, a case base 925, a primer 930, a propellant 935, flechettes 945, cubes 950, balls 955, chemlucent chemical 1, 540, and chemlucent chemical 2, 550. Case base 925 comprises a seal, not shown. The flechettes 945, cubes 950, and balls 955 are collectively referenced as multiple projectiles 960 In an embodiment, the multiple projectiles 960 comprise steel. In a further embodiment, the multiple projectiles 960 comprise tungsten.

The plastic spider 1015 containing plastic or composite vials 1010 is placed in bag 1020 and surrounded by chemlucent chemical 2, 550. Multiple projectiles 960 may be coated with chemlucent chemical 2, 550, in liquid form and allowed to dry. In addition, multiple projectiles 960 may optionally be surrounded by chemlucent chemical 2, 550, in powder form.

In one embodiment, bag 940 containing chemlucent chemical 2, 550, in liquid form or contained in glass, plastic or composite vials and then placed in bag 940 and bag 1020 may be placed in other locations among the multiple projectiles 960. Optionally, multiple projectiles 960 may be coated with chemlucent chemical 2, 550, in liquid form and allowed to dry. In addition, multiple projectiles 960 may optionally be surrounded by chemlucent chemical 2, 550, in powder form.

In a further embodiment, chemlucent chemical 1, 540, and chemlucent chemical 2, 550, may be placed in separate bags and positioned within tank or artillery main projectile 910 to allow multiple projectiles 960 to pass through both bags, breaking the bags. Alternatively, the separate bags break under the forces induced by gun launch of main tank or artillery main projectile 910. Chemlucent chemical 1, 540, and chemlucent chemical 2, 550, combine and adhere to multiple projectiles 960 and emit light. Optionally, multiple projectiles 960 are coated with chemlucent chemical 2, 550, in liquid form and allowed to dry. In addition, multiple projectiles 960 are optionally surrounded by chemlucent chemical 2, 550, in powder form.

Figure 11:
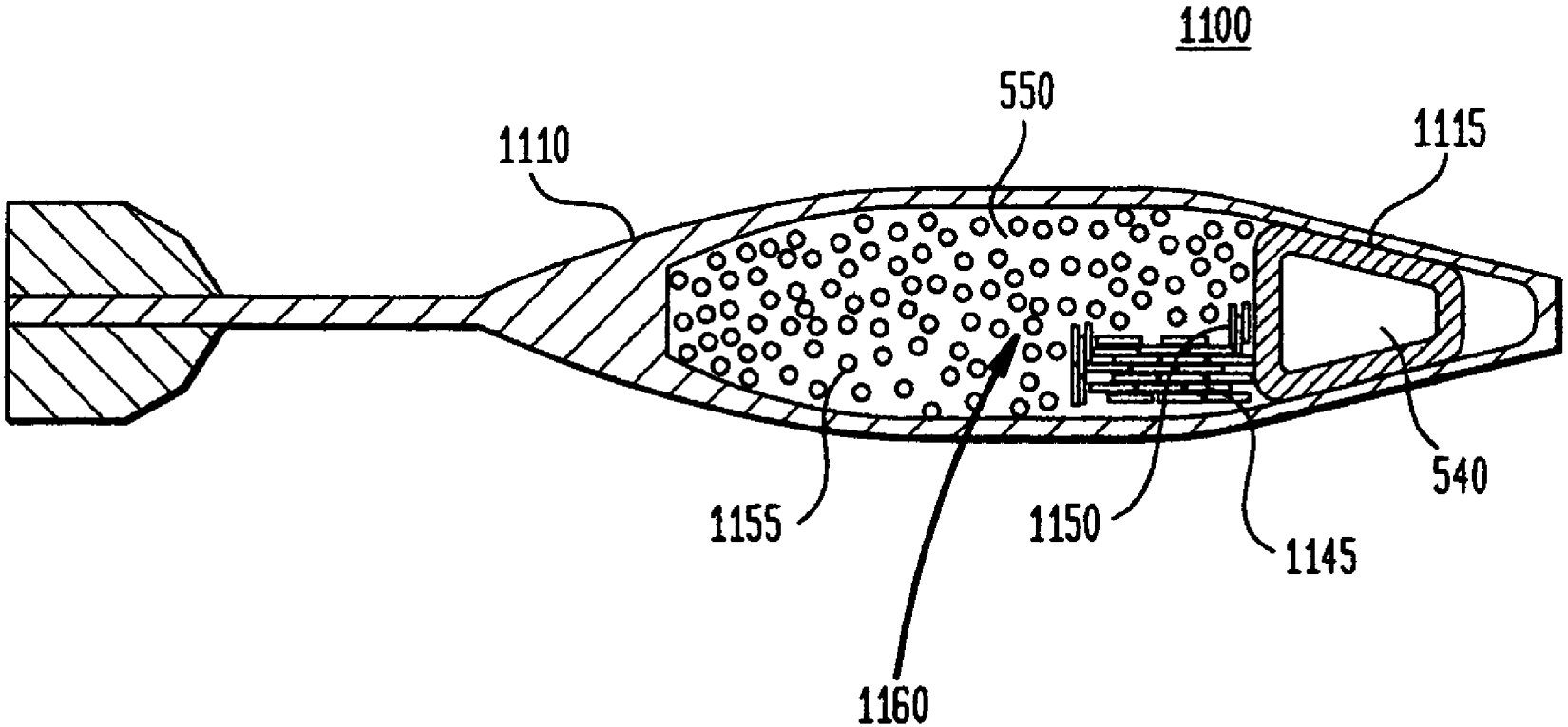
FIG. 11 is a cross-sectional view of a 60, 81, or 120 mm mortar projectile showing the location of chemlucent chemical in a plastic or composite bag and various multiple projectiles coated with chemlucent chemicals.

FIG. 11 is a cross-sectional view of a 60, 81, or 120 mm mortar projectile 1100 (also referenced as mortar projectile 1100). Mortar projectile 1100 comprises main projectile 1110, bag 1115, chemlucent chemical 1, 540, chemlucent chemical 2, 550, flechettes 1145, cubes 1150, and balls 1155. The flechettes 1145, cubes 1150, and balls 1155, collectively referenced as multiple projectiles 1160, are coated with chemlucent chemical 2. In an embodiment, the multiple projectiles 1160 comprise steel. In a further embodiment, the multiple projectiles 1160 comprise tungsten.

The multiple projectiles 1160 are placed in the mortar projectile 1100 with bag 1115 containing chemlucent chemical 1, 540. When the mortar projectile 1100 is fired or launched from the gun, multiple projectiles 1160 puncture bag 1115 and pass through bag 1115. Alternatively, bag 1115 breaks under the setback forces induced by gun launch of the mortar projectile 1100. Chemlucent chemical 1, 540, combines with chemlucent chemical 2, 550, and the projectiles 1160 to emit light, providing a trajectory trace and target mark.

In an embodiment, optional chemlucent chemical 2, 550, in powder form (i.e. oxalate powder) is loaded in the mortar projectile 1100 with multiple projectiles 1160. When the powdered chemlucent chemical 2, 550, in powder form combines with chemlucent chemical 1, 540, the resulting chemlucent chemical mixture emits light. In another embodiment, chemlucent chemical 1, 540, and chemlucent chemical 2, 550, comprise an infrared (IR) formulation requiring night vision devices (NVD) to observe the trace and mark.

Figure 12:
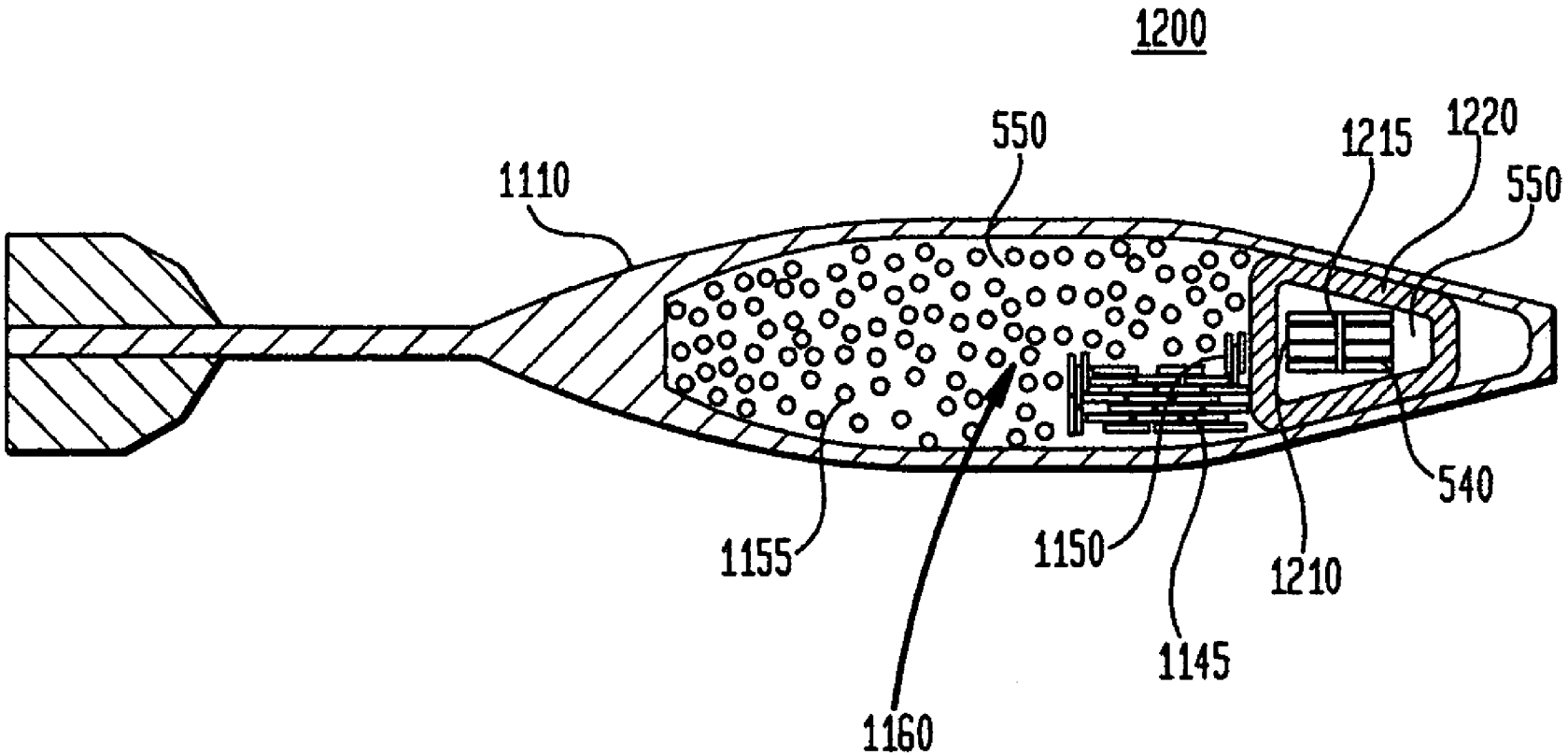
FIG. 12 is a cross-sectional view of a 60, 81, or 120 mm mortar projectile showing the coated multiple projectiles surrounded by an optional chemlucent chemical powder and the chemlucent chemicals in glass or plastic or composite vials suspended in a plastic spider and surrounded by an optional chemlucent chemical powder.

FIG. 12 is a cross-sectional view of 60, 81, or 120 mm mortar projectile 1200 (also referenced as mortar projectile 1200) with chemlucent chemical 1, 540, placed in glass vials 1210 held apart by a plastic spider 1215. Mortar projectile 1200 comprises main projectile 1110, bag 1220, chemlucent chemical 1, 540, chemlucent chemical 2, 550, flechettes 1145, cubes 1150, and balls 1155. The flechettes 1145, cubes 1150, and balls 1155, are collectively referenced as projectiles 1160. In an embodiment, the projectiles 1160 comprise steel. In a further embodiment, the projectiles 1160 comprise tungsten.

The plastic spider 1215 is placed in bag 1220 and surrounded by chemlucent chemical 2, 550. Multiple projectiles 1160 are coated with chemlucent chemical 2, 550, in liquid form and allowed to dry. In addition, multiple projectiles 1160 may optionally be surrounded by chemlucent chemical 2, 550, in powder form.

In another embodiment, a bag 1115 m (not shown)ay contain chemlucent chemical 2550 in either liquid or powder form. Bag 1115 an(not shown) d bag 1220 may be placed in other locations among the multiple projectiles 1160. Optionally, projectiles 1160 may be coated with chemlucent chemical 2, 550, in liquid form and allowed to dry. In addition, projectiles 1160 may optionally be surrounded by chemlucent chemical 2, 550, in powder form.

In a further embodiment, chemlucent chemical 1, 540, and chemlucent chemical 2, 550, may be placed in separate bags and positioned within mortar projectile 1100 to allow projectiles 1160 to puncture the bags. Alternatively, the separate bags break under the setback forces induced by gun launch of main projectile 1100. Chemlucent chemical 1, 540, and chemlucent chemical 2, 550, combine and adhere to projectiles 1160 and emit light. Optionally, projectiles 1160 are coated with chemlucent chemical 2, 550, in liquid form and allowed to dry. In addition, projectiles 1160 are optionally surrounded by chemlucent chemical 2, 550, in powder form.

Projectile 1200 FIG. 12 and projectile 1100 FIG. 11 are usually cargo projectiles. Therefore, the main projectile 1110 will provide trace if it is transparent or translucent and will not provide trace if it is opaque. After expulsion of the multiple projectiles 1160 the main projectile 1110 falls to the ground and the chemlucent coated multiple projectiles 1160 along with the option chemlucent powder provide trace and mark.

It is to be understood that the specific embodiments of the invention that have been described are merely illustrative of certain applications of the principle of the present invention. Numerous modifications may be made to the system and method for a flameless tracer/marker for ammunition housing multiple projectiles utilizing chemlucent chemicals described herein without departing from the spirit and scope of the present invention.

What is claimed is:

1. A flameless tracer/marker for an ammunition housing a multitude of projectiles utilizing chemlucent chemicals, comprising: a light-emitting chemical carried by each projectile for emitting light visible to an observer during a flight of the ammunition, wherein the light-emitting chemical comprises a mixture of a first chemlucent chemical and a second chemlucent chemical, and wherein the first chemlucent chemical is contained in a plurality of glass vials which are restrained by a spider and emplaced in a bag.

2. The tracer/marker of claim 1, wherein the second chemlucent chemical n powdered form is placed in the bag with the glass vials.

3. The tracer/marker of claim 2, wherein the bag is placed in the ammunition.

4. The tracer/marker of claim 1, wherein the second chemlucent chemical is contained in some of the glass vials.

5. The tracer/marker of claim 4, wherein the glass vials break during gun launch of the projectile, mixing first and second chemlucent chemicals.

6. The tracer/marker of claim 4, wherein the projectiles puncture the bag, mixing the first and second chemlucent chemicals.

7. The tracer/marker of claim 4, wherein the projectile is made of an opaque material, wherein no light is seen of the projectile flight to the target but only a light is detected on the target after ammunition impact with the target.

* * * * *